US006199776B1

(12) United States Patent
Andorfer

(10) Patent No.: US 6,199,776 B1
(45) Date of Patent: Mar. 13, 2001

(54) FUEL INJECTION VALVE AND METHOD FOR THE PRODUCTION OF A VALVE NEEDLE FOR A FUEL INJECTION VALVE

(75) Inventor: Martin Andorfer, Münchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/355,121

(22) PCT Filed: Aug. 20, 1998

(86) PCT No.: PCT/DE98/02434

§ 371 Date: Dec. 14, 1999

§ 102(e) Date: Dec. 14, 1999

(87) PCT Pub. No.: WO99/27246

PCT Pub. Date: Jun. 3, 1999

(30) Foreign Application Priority Data

Nov. 22, 1997 (DE) ..... 197 84 847

(51) Int. Cl.[7] ..... F02M 51/00

(52) U.S. Cl. ..... 239/585.4; 239/585.1; 239/900; 29/890.13; 251/129.21

(58) Field of Search ..... 239/585.1, 585.4, 239/585.5, 900; 251/129.21; 29/890.124, 890.126, 890.13, 890.132

(56) References Cited

U.S. PATENT DOCUMENTS 4,483,485 11/1984 Kamiya .
4,552,312 * 11/1985 Ohno et al. ..... 239/585.1
4,944,486 * 7/1990 Babitzka ..... 251/129.21
4,967,966 11/1990 Babitzka .
5,199,648 * 4/1993 Fujikawa ..... 239/585.4
5,820,031 * 10/1998 Reiter et al. ..... 239/585.1
5,875,975 * 3/1999 Reiter et al. ..... 239/585.1
6,045,116 * 4/2000 Willke et al. ..... 239/585.1 X

FOREIGN PATENT DOCUMENTS 38 31 196 3/1990 (DE) .
40 08 675 9/1991 (DE) .
62-087661 9/1987 (JP) .

* cited by examiner

*Primary Examiner*—Lesley D. Morris
(74) *Attorney, Agent, or Firm*—Kenyon & Kenyon

(57) ABSTRACT

A fuel injection valve that possesses an axially movable valve needle which includes at least one armature and one spherical valve closure element. The armature forms a closure element support which is joined at its downstream end to the valve closure element. The end of the closure element support facing toward the valve closure element is deformed in such a way that a polygonal profile is present. In accordance with the number of profile edges, at least two flowthrough openings, communicating with an inner longitudinal bore, are formed between the closure element support and the surface of the valve closure element, through which openings fuel can easily flow.

14 Claims, 2 Drawing Sheets

FUEL INJECTION VALVE AND METHOD FOR THE PRODUCTION OF A VALVE NEEDLE FOR A FUEL INJECTION VALVE

BACKGROUND INFORMATION

The present invention is based on a fuel injection valve, and on a method for manufacturing a valve needle of a fuel injection valve.

A fuel injection valve in which a valve needle is constituted from an armature, a tubular joining part, and a spherical valve closure element is already known from German Published Patent Application 38 31 196 or German Published Application Patent no. 40 08 675. The armature and the valve closure element are joined to one another via the tubular joining element, the joining part, to which the valve closure element is immovably joined via a weld bead, serving as the immediate closure element support. The joining part has a plurality of transversely extending flow openings through which fuel can emerge from an internal passthrough opening and flow, outside the joining part, to the valve closure element and to a valve seat surface coacting with the valve closure element. In addition, the joining tube has a longitudinal slit, extending over the entire length, through which, because of its large hydraulic flow cross section, fuel arriving from the inner passthrough opening can flow very quickly. Most of the fuel to be discharged already flows out of the joining part over its length. The remaining quantity emerges directly from the joining part only upon reaching the spherical surface, so that when viewed over the joining region between joining part and valve closure element, which extends over 360 degrees, there is a definite inhomogeneity in fuel distribution.

SUMMARY OF THE INVENTION

The fuel injection valve according to the present invention, has the advantage that opportunities for fuel flow at the valve needle can be created in economical, reliable, and particularly simple fashion. The valve needle includes at least one closure element support and one valve closure element. The closure element support is shaped, at its end facing the valve closure element, in a manner which deviates from an annular profile such that at least two flowthrough openings are formed between the closure element support and the surface of the valve closure element, through which fuel arriving from an inner longitudinal bore can flow unimpeded toward a valve seat surface. In particularly simple fashion, the downstream end of the closure element support is plastically deformed by deformation tools from an annular profile into a polygonal profile. Optimum flow to the metering region of the valve is thus achieved with little production outlay.

Advantageously, the fuel flows to the surface of the valve closure element in the interior of the closure element support. As compared with known valves, this eliminates transverse openings and slits in the closure element support, which are otherwise needed for the fuel to emerge from the internal sleeve opening of the closure element support. Also eliminated are the machining problems (e.g. deburring) associated with such transverse openings.

In particularly advantageous fashion, the valve closure element is of spherical configuration, so that centering of the valve closure element on the closure element support is particularly easy.

The polygonal profile of the closure element support has an equal number of angle regions and edge regions, corresponding to the number of flowthrough openings. A triangular profile results in the best compromise between the greatest possible open cross section for the sum of the flowthrough openings and good centering of the valve closure element on the closure element support. Great variability in the individual profiles of the closure element support can be created by using different deformation tools.

In particularly advantageous fashion, the armature can itself serve directly as the closure element support, so that together with the valve closure element a two-part valve needle is present. A valve needle of this kind is particularly easy and economical to manufacture, and because of the reduced parts count has only the join to be made between the valve closure element and closure element support.

DETAILED DESCRIPTION

Figure 1:
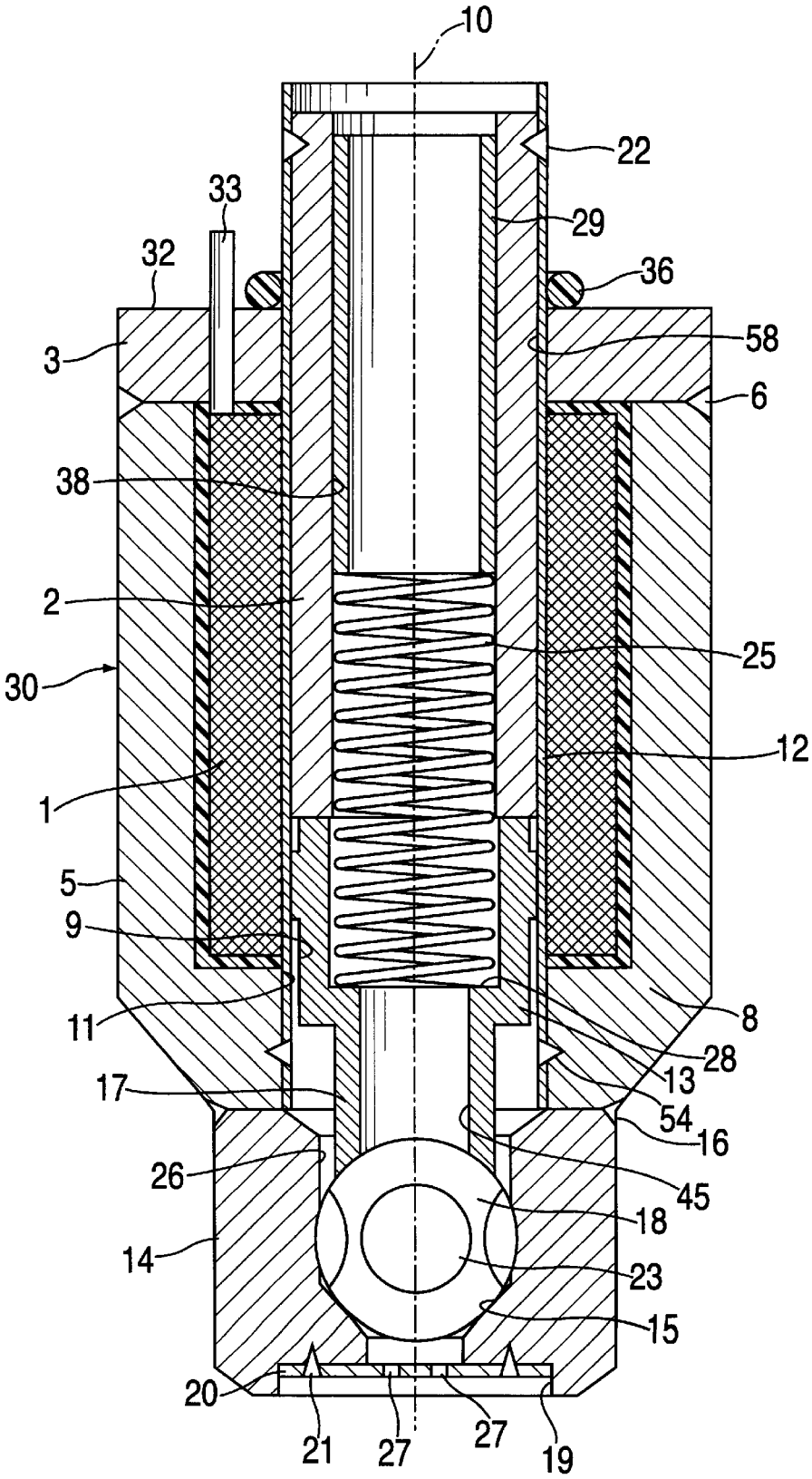
FIG. 1 shows a fuel injection valve according to the present invention.

The valve according to the present invention depicted in the form of an electromagnetically actuable fuel injection valve for fuel injection systems of mixture-compressing, spark-ignited internal combustion engines, has a largely tubular core 2 which is surrounded by a magnet coil 1 and serves as internal pole and partly as a fuel passage. Together with an upper disk-shaped cover element 3, core 2 makes possible a particularly compact configuration of the injection valve in the region of magnet coil 1. Magnet coil 1 is surrounded by an external ferromagnetic valve shell 5 constituting the external pole, which completely surrounds magnet coil 1 in the circumferential direction and is immovably joined at its upper end to cover element 3, e.g. by a weld bead 6. To close the magnetic circuit, valve shell 5 is embodied in stepped fashion at its lower end, thus forming a guide segment 8 which, similarly to cover element 3, axially encloses magnet coil 1 and represents the boundary of magnet coil region 1 toward the bottom or in the downstream direction.

Guide segment 8 of valve shell 5, magnet coil 1, and cover element 3 form an internal opening 11 and 58, running concentrically with a longitudinal valve axis 10, in which an elongated sleeve 12 extends. An inner longitudinal opening 9 of ferritic sleeve 12 serve partly as guide opening for a valve needle 13 that is axially movable along longitudinal valve axis 10. Sleeve 12 is therefore produced in dimensionally accurate fashion with respect to the inside diameter of internal opening 9. Viewed in the downstream direction, sleeve 12 ends, for example, in the region of guide segment 8 of valve shell 5, to which it is immovably joined, for example, with a weld bead 54. The stationary core 2 is also arranged in longitudinal opening 9 of sleeve 12 outside the axially movable valve needle 13. In addition to receiving core 2, sleeve 12 also performs a sealing function, so that magnet coil 1 present in the injection valve is dry. This is also achieved by the fact that the disk-shaped cover element 3 completely covers magnet coil 1 on its upper side. Inner opening 58 in cover element 3 makes it possible to configure sleeve 12 and thus also core 2 in elongated fashion, so that both components pass through opening 58 and project beyond cover element 3.

Adjoining the lower guide segment 8 of valve shell 5 is a valve seat element 14 which has a fixed valve seat surface 15 constituting a valve seat. Valve seat element 14 is immovably joined to valve shell 5, by way of a second weld bead 16 produced, for example, with a laser. Valve needle 13 is constituted by a tubular armature 17 and a, for example, spherical valve closure element 18 joined immovably thereto, armature 17 serving directly as the closure element support. Valve closure element 18 has on its circumference, for example, five flattened areas 23 which allow fuel to flow past valve closure element 18 to valve seat surface 15. Arranged at the downstream end face of valve seat element 14, for example in a depression 19, is a flat perforated spray disk 20, the immovable joining between valve seat element 14 and perforated spray disk 20 being attained, for example, using a peripheral sealed weld bead 21.

Actuation of the injection valve is accomplished, in known fashion, electromagnetically. The electromagnetic circuit having magnet coil 1, inner core 2, outer valve shell 5, and armature 17 serves to move valve needle 13 axially, and thus to open the injection valve against the spring force of a return spring 25 and to close it. Armature 17 faces toward core 2 with its end which faces away from valve closure element 18.

The spherical valve closure element 18 coacts with valve seat surface 15 of valve seat element 14, that surface tapering in truncated conical form in the flow direction and being configured in valve seat element 14 axially downstream of a guide opening 26. Perforated spray disk 20 possesses at least one, for example four spray openings 27 shaped by electrodischarge machining or punching.

The depth to which core 2 is inserted in the injection valve governs, inter alia, the linear stroke of valve needle 13. The one end position of valve needle 13, when magnet coil 1 is not energized, is defined by contact of valve closure element 18 against valve seat surface 15 of valve seat element 14, while the other end position of valve needle 13, when magnet coil 1 is energized, results from contact of armature 17 against the downstream end of core 2. Linear stroke adjustment is performed by axial displacement of core 2 in sleeve 12, which, in accordance with the desired position, is then immovably joined to sleeve 12, a laser weld being useful for producing a weld bead 22.

In addition to return spring 25, an adjusting sleeve 29 is inserted into a flow bore 38 of core 2 which runs concentrically with longitudinal valve axis 10 and serves to convey fuel toward valve seat surface 15. Adjusting sleeve 29 serves to adjust the spring preload of return spring 25, which rests against adjusting sleeve 29 and in turn is braced at its opposite end against a shoulder 28 of armature 17; the dynamic spray discharge volume is also adjusted using adjusting sleeve 29.

An injection valve of this kind is characterized by its particularly compact configuration, resulting in a very small, manageable injection valve whose valve shell 5 has, for example, an outside diameter of only approximately 11 mm. The components so far described form a preassembled independent assembly which can be referred to as functional part 30. The completely adjusted and assembled functional part 30 has, for example, an upper end surface 32 beyond which, for example, two contact pins 33 project. By way of electrical contact pins 33, which serve as electrical connecting element, electrical contact is made to magnet coil 1 and it is thereby energized.

A functional part 30 of this kind can be joined to a connector part (not depicted), which is characterized principally in that it comprises the electrical and hydraulic connection to the injection valve. A hydraulic connection between the connector part (not depicted) and functional part 30 is achieved, when the injection valve is completely assembled, by the fact that flow bores of the two assemblies are brought together so as to ensure that fuel can flow through unimpeded. In this context, for example, end surface 32 of functional part 30 rests directly against a lower end surface of the connector part, and is immovably joined thereto. When the connector part is mounted onto functional part 30, the portion of core 2 and of sleeve 12 projecting beyond end surface 32 can, in order to increase connection stability, project into a flow bore of the connector part. For secure sealing, a sealing ring 36, for example, is provided in the joining region, resting on end surface 32 of cover element 3 and surrounding sleeve 12. In the completely assembled valve, contact pins 33 serving as electrical connection elements participate in a secure electrical connection with corresponding electrical connection elements of the connector part.

Figure 2:
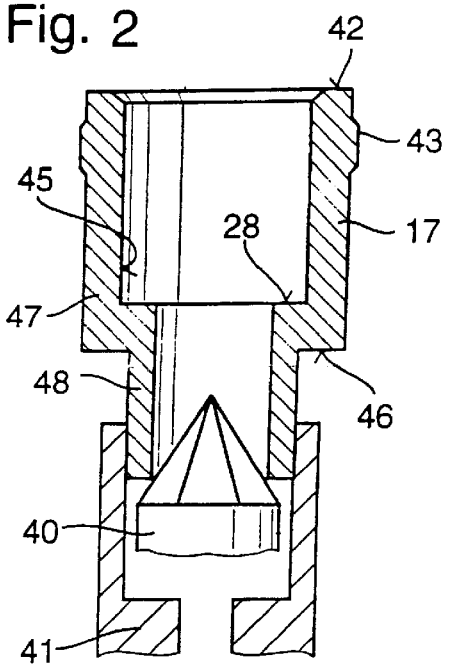
FIG. 2 shows an armature, serving as closure element support, with a deformation tool.

FIG. 2 shows armature and closure element support 17, at a larger scale than in FIG. 1, with a deformation tool 40 and 41. The tubular armature serving as closure element support 17 is embodied, for example, as a turned part which possesses, in addition to an inner longitudinal bore 45 that is stepped thanks to shoulder 28, a stepped outer contour as well. Closure element support 17, made for example from a ferritic material (e.g. 13% chromium steel), has an upper stop surface 42, facing core 2, which is equipped with a wear protection layer, i.e. is chrome-plated. Shaped out of the external periphery of closure element support 17, in a larger-diameter first segment 47, is, for example, an annular guide surface 43 which serves to guide the axially movable valve needle 13 in sleeve 12. Analogously to shoulder 28 in inner longitudinal bore 45, a step 46 is provided on the outer contour, resulting in a reduction in cross section in a second segment 48 when viewed in the downstream direction. Larger- and smaller-diameter segments 47 and 48 each initially possess a circular cross section.

Figure 4:
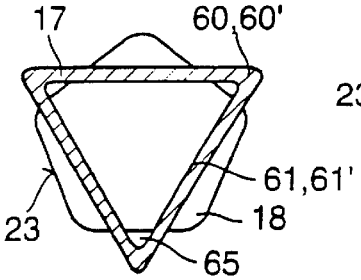
FIG. 4 shows a section through a closure element support with a triangular profile, along line IV—IV in FIG. 3.

According to the present invention, the annular cross section of the end of closure element support 17 facing the spherical valve closure element 18, i.e. in the exemplary embodiment that of segment 48 shown in FIG. 2, is changed into a cross section which has at least two corners 60 and edges 61 (FIG. 4). Corners 60 and edges 61 do not by any means, however, need to be sharp-edged or straight. Instead, corners 60 can be rounded and edges 61 can be curved, i.e. bulging. In order to obtain a profile of this kind which deviates from a hollow cylindrical shape, a plastic deformation of the joining region, at which valve closure element 18 that is to be mounted is later attached, is performed in segment 48. As already indicated in FIG. 2 with the two deformation tools 40 and 41, there are two possibilities for deforming closure element support 17 at its lower segment 48 facing toward valve closure element 18. The first deformation possibility lies in introducing a deformation tool 40 into the inner longitudinal bore 45 in segment 48 and performing a desired deformation of segment 48 from the inside. The second deformation possibility provides for allowing a deformation tool 41 to act on the outer periphery of segment 48 in order to achieve a desired deformation of segment 48. In addition, for example, it is possible also to introduce a shaping punch into the inner longitudinal bore 45 and apply to the outer periphery a deformation tool 41 with which the contour of the shaping punch is reproduced in segment 48.

Figure 3:
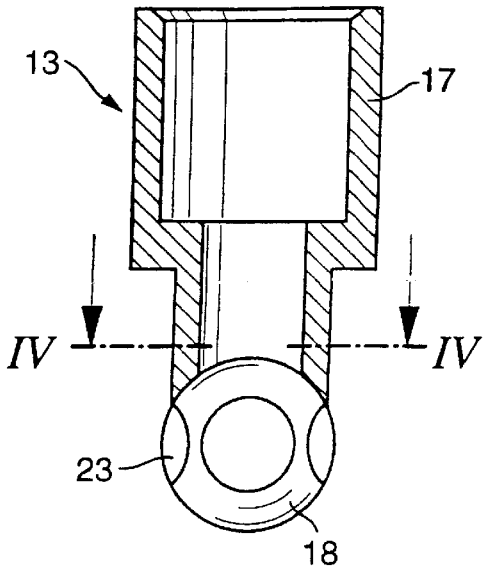
FIG. 3 shows a two-part valve needle.

After the deformation of segment 48 of closure element support 17, spherical valve closure element 18 is immovably attached to this deformed segment 48, thus completing the axially movable valve needle 13, as is evident from FIG. 3. Valve closure element 18 is joined to the respective edge regions 61' of the deformed profile; as is desired, immovable joins cannot be made in corner regions 60'. The immovable joins between closure element support 17 and valve closure element 18 are created, for example, by way of weld beads 63 produced with a laser, the number of weld beads 63 corresponding exactly to the number of edge regions 61'.

The formation of corner regions 60' results in the creation of regions at the downstream end of segment 48 which do not rest against the surface of valve closure element 18. The result of the plastic deformation of segment 48 has thus been to create at corner regions 60' flowthrough openings 65 through which, in particularly favorable fashion, fuel arriving from longitudinal bore 45 flows toward valve seat surface 15. This embodiment of valve needle 13 allows fuel to flow in very simple fashion to the metering region of the injection valve.

Figure 5:
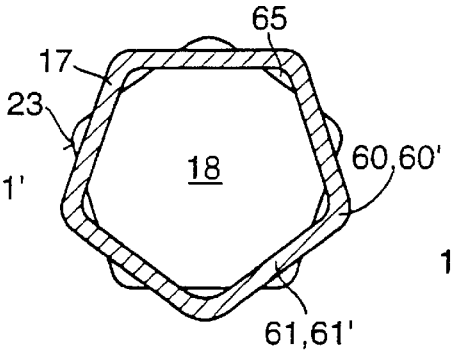
FIG. 5 shows a section through a closure element support with a pentagonal profile.

FIG. 4 is a sectioned depiction of a section along line IV—IV in FIG. 3 which illustrates in particularly descriptive fashion corner s 60 and edges 61 of closure element support 17, and flowthrough openings 65, after the attachment of valve closure element 18. It is particularly advantageous to use deformation tools 40, 41 with shaping punches with which a triangular profile can be produced. The three corner regions 60' and three edge regions 61' in the profile of segment 48 result in three flowthrough openings 65. Valve closure element 18 is attached to edge regions 61' with three weld beads 63. A triangular profile yields the best compromise between the greatest possible open cross section for the sum of flowthrough openings 65, and good centering of valve closure element 18 on closure element support 17. In addition to a triangular profile, however, profiles with two, four, five (FIG. 5), or possibly even more corners 60 and edges 61 are also conceivable for closure element support 17.

Figure 6:
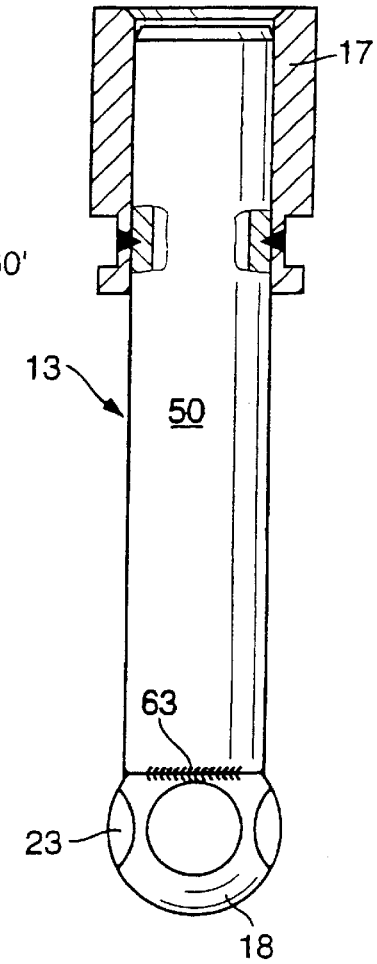
FIG. 6 shows a tripartite valve needle.

FIG. 6 depicts a second exemplary embodiment of a valve needle 13 in which parts which remain the same as or operate identically to those in the exemplary embodiment depicted in FIG. 3 are identified by the same reference characters. Valve needle 13 as shown in FIG. 6 is distinguished from valve needle 13 shown in FIG. 3 by its tripartite nature. In this exemplary embodiment of valve needle 13, armature 17 and valve closure element 18 are joined to one another by a sleeve-like joining part 50.

Valve closure element 18 is again provided immovably on valve needle 13, by way of weld be ads 63 in the manner described above, but in this case not to armature 17 but rather to joining part 50 which now serves as the closure element support. All statements regarding the deformation of segment 48 on closure element support 17 in the example according to FIG. 2 are entirely transferrable to joining part 50 according to FIG. 6, since the geometry and function are comparable.

In addition to the configuration of closure element support 17, 50 as a turned part or cold-pressed part, embodiments as a sintered part or metal injection-molded (MIM) part are also possible.

Figure 7:
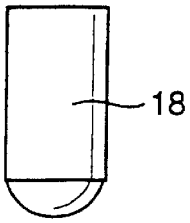
FIG. 7 shows a first illustration of a valve closure element that deviates from a spherical shape and can be mounted on a closure element support.
Figure 8:
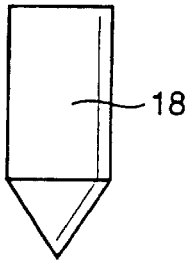
FIG. 8 shows a second illustration of a valve closure element that deviates from a spherical shape and can be mounted on a closure element support.
Figure 9:
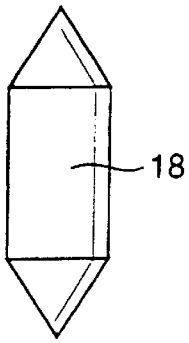
FIG. 9 shows a third illustration of a valve closure element that deviates from a spherical shape and can be mounted on a closure element support

It should be mentioned that while the spherical shape of valve closure element 18 is particularly preferred because of its ease of centering, it is nevertheless not exclusive. Indeed, valve closure elements 18 having a cylindrical shape with a spherical polished portion (FIG. 7), a cylindrical shape with a conical tip (FIG. 8), a cylindrical shape with two opposing conical tips (FIG. 9), a semi-spherical shape, and so forth, can also be attached to closure element support 17, 50.

What is claimed is:

1. A fuel injection valve, comprising:

a magnet coil;

a core at least partially surrounded by the magnet coil and having a longitudinal valve axis;

a fixed valve seat; and an axially movable valve needle at least partially surrounded by the core and including at least one closure element support and a valve closure element, the valve closure element being immovably joined to the at least one closure element support and coacting with the fixed valve seat, and the at least one closure element support having an inner longitudinal bore extending to a surface of the valve closure element, wherein:

an end of the at least one closure element support facing the valve closure element includes a contour that deviates from an annular profile such that at least two flowthrough openings in communication with the inner longitudinal bore are formed between the at least one closure element support and the surface of the valve closure element.

2. The valve according to claim 1, wherein the contour of the end of the at least one closure element support facing the valve closure element has a triangular profile.

3. The valve according to claim 1, wherein the contour of the end of the at least one closure element support facing the valve closure element has a pentagonal profile.

4. The valve according to claim 1, wherein a downstream end of the at least one closure element support includes corner regions and edge regions in an equal number, the number of corner regions and edge regions corresponding to a number of the at least two flowthrough openings.

5. The valve according to claim 4, wherein each edge region is an attachment region for the valve closure element on the at least one closure element support.

6. The valve according to claim 5, wherein the valve closure element is immovably joined to the edge regions by way of weld beads.

7. The valve according to claim 1, wherein an outer periphery of the valve closure element includes a plurality of flattened areas.

8. The valve according to claim 1, wherein the at least one le;.5qclosure element support is formed as an armature.

9. The valve according to claim 1, further comprising:

an armature;

a joining part serving as the at least one closure element support and joining the armature and the valve closure element.

10. The valve according to claim 1, wherein the at least one closure element support corresponds to one of a turned part and a cold-pressed part.

11. The valve according to claim 1, wherein a configuration of the valve closure element is spherical.

12. A method for manufacturing a valve needle of a fuel injection valve, comprising the steps of:

providing a metal closure element support having:

an inner longitudinal bore,
a circular cross section, and
a circular outer contour;

providing a valve closure element;

using at least one deformation tool to plastically deform an end of the metal closure element support that is to face toward the valve closure element such that the metal closure element support includes at the end that is to face toward the valve closure element a contour that deviates from an annular profile, the metal closure element including a plurality of corner regions and a plurality of edge regions; and subsequent to the step of using the at least one deformation tool, attaching the valve closure element to the deformed end of the metal closure element support.

13. The method according to claim 12, further comprising the step of:

attaching an armature on a side of the metal closure element support located opposite to the valve closure element.

14. The method according to claim 12, further comprising the step of performing one of the steps of:

engaging the at least one deformation tool in the inner longitudinal bore, and engaging the at least one deformation tool on an outer periphery of the metal closure element support.

* * * * *

UNITED STATES PATENT AND TRADEMARK OFFICE

CERTIFICATE OF CORRECTION

PATENT NO. : 6,199,776 B1
DATED : March 13, 2001
INVENTOR(S) : Martin Andorfer

It is certified that error appears in the above-identified patent and that said Letters Patent is hereby corrected as shown below:

Column 1,
Line 12, change "Application" to -- Application No. --.
Line 13, change "Application Patent no." to -- Patent Application No. --.

Column 5,
Line 60, change "be ads" to -- beads --.

Column 6,
Line 54, change "le;. 5qclosure" to -- closure --.

Signed and Sealed this

Twenty-sixth Day of February, 2002

*Attest:*

*Attesting Officer*

JAMES E. ROGAN
*Director of the United States Patent and Trademark Office*